US008368557B2

(12) United States Patent
Stählin et al.

(10) Patent No.: US 8,368,557 B2
(45) Date of Patent: Feb. 5, 2013

(54) INFORMATION DEVICE FOR THE ADAPTED PRESENTATION OF INFORMATION IN A VEHICLE

(75) Inventors: Ulrich Stählin, Eschborn (DE); Peter Rieth, Eltville (DE)

(73) Assignee: Continental Teves AG & Co. oHG (DE)

( * ) Notice: Subject to any disclaimer, the term of this patent is extended or adjusted under 35 U.S.C. 154(b) by 335 days.

(21) Appl. No.: 12/674,570

(22) PCT Filed: Apr. 29, 2008

(86) PCT No.: PCT/EP2008/055250

§ 371 (c)(1),
(2), (4) Date: Feb. 22, 2010

(87) PCT Pub. No.: WO2009/030525

PCT Pub. Date: Mar. 12, 2009

(65) Prior Publication Data

US 2011/0199230 A1 Aug. 18, 2011

(30) Foreign Application Priority Data

Aug. 29, 2007 (DE) ..... 10 2007 041 048
Apr. 29, 2008 (DE) ..... 10 2008 021 475

(51) Int. Cl.
*G08G 1/00* (2006.01)

(52) U.S. Cl. ..... 340/901; 340/902; 340/905; 340/907

(58) Field of Classification Search ..... 340/901–907, 340/943, 933, 988, 693.3, 435, 539.1, 539.12, 340/961, 990, 945, 995.17; 701/200, 210, 701/2, 3, 300, 301, 516
See application file for complete search history.

(56) References Cited

U.S. PATENT DOCUMENTS

| | | | | |
|---|---|---|---|---|
| 4,952,931 | A * | 8/1990 | Serageldin et al. | 340/902 |
| 5,493,291 | A | 2/1996 | Brüggemann | |
| 5,572,201 | A * | 11/1996 | Graham et al. | 340/902 |
| 6,362,749 | B1 * | 3/2002 | Brill | 340/902 |
| 6,417,782 | B1 | 7/2002 | Darnall | |
| 6,560,529 | B1 | 5/2003 | Janssen | |
| 6,686,849 | B1 * | 2/2004 | Cullett | 340/902 |
| 6,836,724 | B2 * | 12/2004 | Becker et al. | 701/516 |
| 6,861,959 | B1 * | 3/2005 | Torres Sabate et al. | 340/944 |
| 7,113,107 | B2 * | 9/2006 | Taylor | 340/901 |
| 2004/0098191 | A1 | 5/2004 | Becker et al. | |
| 2007/0050183 | A1 * | 3/2007 | Kao et al. | 704/3 |
| 2007/0194950 | A1 | 8/2007 | Boss et al. | |

FOREIGN PATENT DOCUMENTS

| | | | |
|---|---|---|---|
| DE | 4310531 | A1 | 10/1994 |
| DE | 19842176 | A1 | 3/2000 |
| DE | 19917792 | A1 | 9/2000 |
| DE | 10053099 | A1 | 5/2002 |
| DE | 102004012104 | A1 | 10/2005 |
| DE | 102005027887 | A1 | 12/2006 |
| DE | 102005035342 | A1 | 12/2006 |
| DE | 102005056881 | A1 | 6/2007 |
| EP | 1276087 | A1 | 1/2003 |

* cited by examiner

*Primary Examiner* — Anh V La
(74) *Attorney, Agent, or Firm* — RatnerPrestia

(57) ABSTRACT

Information for a vehicle driver is transmitted to the vehicle by vehicle-to-vehicle or vehicle-to-infrastructure communication and is individually conditioned in the vehicle in line with the respective needs of the driver. The conditioned information is then presented visually and/or audibly.

12 Claims, 2 Drawing Sheets

INFORMATION DEVICE FOR THE ADAPTED PRESENTATION OF INFORMATION IN A VEHICLE

CROSS-REFERENCE TO RELATED APPLICATIONS

This application is the U.S. national phase application of PCT International Application No. PCT/EP2008/055250, filed Apr. 29, 2008, which claims priority to German Patent Application No. 10 2007 041 048.6, filed Aug. 29, 2007, and German Patent Application No. 10 2008 021 475.2, filed Apr. 29, 2008, the content of such applications being incorporated by reference herein.

FIELD OF THE INVENTION

The invention relates to information technology and safety engineering for vehicles. In particular, the invention relates to an information device for a vehicle, an information system, the use of an information device in a vehicle, a method, a computer program product and a computer-readable medium.

BACKGROUND OF THE INVENTION

In modern vehicles, soundproofing against exterior noise is increasing in quality. In addition, the quality of the music systems in the vehicle is becoming better and better. As a result, there is the risk that ambient noise and hence also warning signals cannot now be perceived sufficiently well by the vehicle occupants.

In-vehicle navigation systems can be used to indicate location information and also changes of course which need to be made. In addition, it is possible to use vehicle-to-vehicle communication or vehicle-to-infrastructure communication to transmit hazard advice to an in-vehicle navigation or driver assistance system.

However, this transmitted information is often ambiguous or even unintelligible to drivers who are in a foreign country. In particular, said transmitted information is often too abstract in order to be able to be processed quickly enough by the driver.

SUMMARY OF THE INVENTION

It is an object of the invention to provide improved information for the driver.

The invention specifies an information device for a vehicle, an information system, the use of an information device in a vehicle, a method, a computer program product and a computer-readable medium.

The exemplary embodiments described relate in equal measure to the information device, the information system, the use, the method, the computer program product and the computer-readable medium.

In line with one exemplary embodiment of the invention, an information device for a vehicle is specified which has a communication unit in the vehicle for the reception of information data from an external transmitter and a control unit for the individual presentation, adapted to suit an occupant of the vehicle or a position of the vehicle, of the received information. In this context, the information corresponds to an emergency vehicle situated in a region around the vehicle or to a road sign situated in the region around the vehicle.

In other words, the information device (which is in the form of a man-machine interface) is sent information regarding particular signage or regarding an emergency vehicle. This information is then conditioned internally and presented to the driver or front-seat passenger. The conditioning of the transmitted information differs individually in this case, according to where the vehicle is situated or who is sitting in the vehicle.

In this way, it is possible to increase the intelligibility of the transmitted information, which is conducive to road safety.

By way of example, this allows the driver to pick up and process the information more quickly. This means that the driver can react as appropriate more quickly.

In other words, the presentation of road signs or the warning of emergency vehicles in the vehicle is thus adapted to suit the driver's habits.

By adapting the presented information to suit the driver's habits, a better recognition value is obtained. This means that the warnings and information are more effective and less confusing.

In line with a further exemplary embodiment of the invention, the transmitter is an adjacent vehicle.

In this context, the information is transmitted via a short-range radio link, for example. The transmission is effected using Dedicated Short Range Communications (DSRC), for example.

It is thus possible to detect particular information from a vehicle in front or an oncoming vehicle. By way of example, this involves the detection of audible signals, such as are emitted by an emergency vehicle, or the visual detection of road signs. This information can then be transmitted to the vehicle (if necessary after appropriate analysis and/or conditioning). By way of example, the transmission can be made following a media conversion. The information data can be transmitted as audible data or video data, for example.

The term media conversion quite generally denotes the transfer, transformation or conversion of a file from one file format to another. This applies to the transfer of data between different media and file systems in exactly the same way as to the transmission of data from one storage medium to another.

It is thus possible, by way of example, for all information to be transmitted by means of a voice link only, so that the receivers do not have the need for decoding.

By way of example, the vehicle is a motor vehicle, such as a car, bus or heavy goods vehicle, or else a rail vehicle, a ship, an aircraft, such as a helicopter or airplane, or, by way of example, a bicycle.

At this juncture, it should be pointed out that, within the context of the present invention, GPS is representative of all Global Navigation Satellite Systems (GNSS), such as GPS, Galileo, GLONASS (Russia), Compass (China), or IRNSS (India), for example.

In line with a further exemplary embodiment of the invention, the transmitter is a static control center.

The information data are transmitted wirelessly using GSM, UMTS, WLAN (e.g. 802.11p) or else using WiMax. It is also possible to use other transmission protocols. The stated protocols afford the advantage of standardization already having taken place.

In line with a further exemplary embodiment of the invention, the presentation of the received information is adapted to suit a country or an area in which the vehicle is situated.

In this way, it is possible for the information to be presented in the relevant language of the country. Since the form of road signs may also differ from country to country, this presentation is also adapted to suit the relevant country/the relevant region.

In line with a further exemplary embodiment of the invention, the information device has a position-finding unit for determining the country or the area in which the vehicle is situated. In this case, the country or the area in which the vehicle is situated can be determined by means of a satellite navigation system, for example in combination with a digital map, or an identification and association of a mobile radio network operator.

This allows the information device to assess how the information needs to be presented.

In line with a further exemplary embodiment of the invention, the presentation of the received information is adapted to suit a country or an area which the driver has selected.

The driver can thus individually determine how he wishes to have the information presented. By way of example, he can select the language and/or how he wishes to have the road signs presented. He can even individually set the tone of a siren. This means that it is possible for the driver to be able to audibly distinguish the siren of a police vehicle from the siren of a fire engine or ambulance service, even though he does not know the different sirens in the country in which he is currently situated.

In other words, the driver can specify that the received data are translated or transformed, so that he is better able to interpret them.

In line with a further exemplary embodiment of the invention, the received information is presented audibly and/or visually.

By way of example, the vehicle contains a plurality of loudspeakers. When an emergency vehicle approaches the vehicle from the left and then passes the vehicle, an appropriate siren is simulated for the driver which approaches the vehicle from the side and then passes the vehicle. In particular, the audible Doppler effect is also simulated.

In line with a further exemplary embodiment of the invention, the received information is presented as a realistic simulation of a sound signal produced by the emergency vehicle.

In line with a further exemplary embodiment of the invention, an information system for the individual presentation, adapted to suit an occupant of a vehicle or a position of the vehicle, of received information is specified, wherein the information system has an information device as described above and a transmitter for the transmission of the information data to the communication unit in the vehicle.

In line with a further exemplary embodiment of the invention, the use of an information device as described above in a vehicle is specified.

In line with the further exemplary embodiment of the invention, a method for the individual presentation, adapted to suit an occupant of a vehicle or a position of the vehicle, of received information is specified, in which information data are received from an external transmitter and the received information are presented by a control unit the vehicle in a manner adapted to suit an occupant of the vehicle or a position of the vehicle. In this case the information corresponds to an emergency vehicle situated in a region around the vehicle or to a road sign situated in the region around the vehicle.

In line with a further exemplary embodiment of the invention, a computer program product is specified which, when executed on a processor, instructs the processor to perform the method steps described above.

In line with a further exemplary embodiment of the invention, a computer-readable medium is specified which stores a computer program product which, when executed on a processor, instructs the processor to perform the method steps described above.

A fundamental consideration of the invention can be seen in that information regarding road signs or warnings of emergency vehicles is transmitted to the vehicle by means of vehicle-to-vehicle or vehicle-to-infrastructure communication, said information being presented either in the usual manner for the country or in line with the driver's habits. The sounds played are conditioned or distorted on the basis of the local circumstances. In addition, the country can be identified using digital maps or a mobile radio network operator (mobile radio carrier).

The term "digital maps" is also intended to be understood to mean maps for advanced driver assistance systems (ADAS), without any navigation taking place.

BRIEF DESCRIPTION OF THE DRAWINGS

The invention is best understood from the following detailed description when read in connection with the accompanying drawings. Included in the drawings is the following features.

Figure 1:
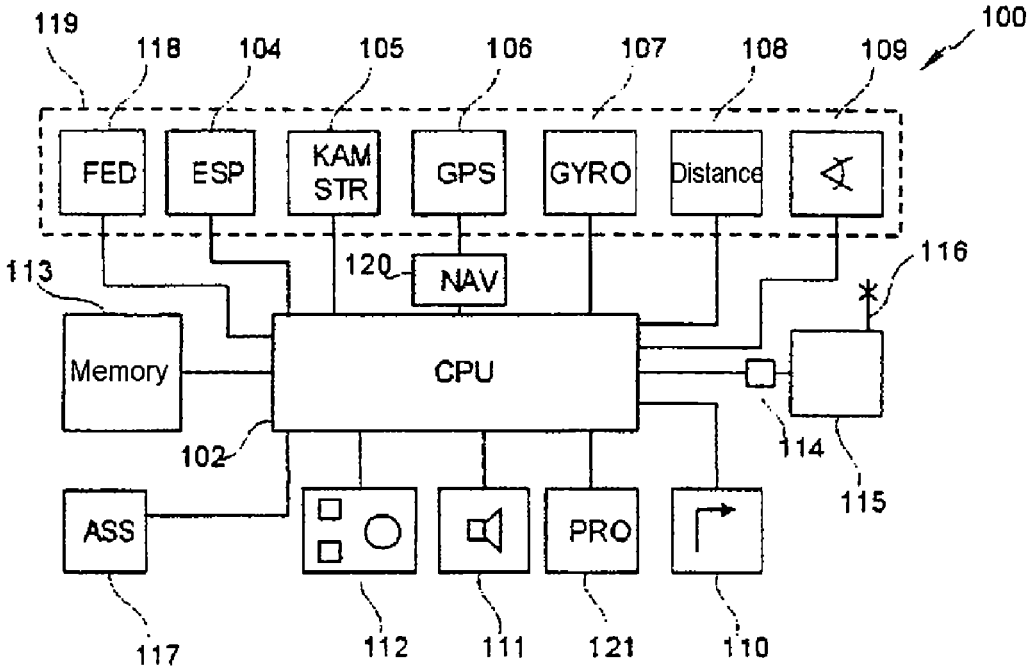
FIG. 1 shows a schematic illustration of an information device based on an exemplary embodiment of the invention.

The illustrations in the Figures are schematic and not to scale.

DETAILED DESCRIPTION OF THE EMBODIMENTS

In the description of the Figures which follows, the same reference numerals are used for the same or similar elements.

FIG. 1 shows a schematic illustration of components of an information device 100 which is installed in a vehicle, for example, and which is used for the individual presentation of received information.

The information device 100 has a communication unit 115 with an antenna 116, has a control unit 102 and one or more loudspeakers 111 for the audible presentation of the conditioned information and has a monitor 110 or projector 121 for the visual presentation of the conditioned information.

In addition, a detection unit 119 may be provided which is used for collecting the measurement data, which can then be transmitted as information data to adjacent vehicles following appropriate conditioning in the control unit 102.

The data to be transmitted, which are transmitted from the control unit 102, which is in the form of a CPU, for example, to the communication unit 115, can be encrypted by means of an encryption device 114. Similarly, the information data which are received from an external transmitter and which are then transmitted from the communication unit 115 to the control unit 102 can be decrypted by the decryption unit 114.

This allows the risk of misuse to be reduced.

The control unit 102 has an input unit 112 connected to it. The input unit 112 allows various settings to be made for the information device and/or the navigation system 120.

The visual output unit 111, which may be a display unit between the speedometer and the rev counter, a main display in the center console or what is known as a head-up display in the windshield, can be used to present the visual components of the conditioned information. Furthermore, routing information can be presented by the navigation unit 120.

The audibly conditioned information can be output via the audible output unit 111. The output via the audible output unit 111 has the advantage that the driver is less distracted from what is currently happening in the traffic.

A memory element 113, which is connected to the control unit 102 or is integrated in the control unit 102, stores the digital map data (e.g. as navigation map data) in the form of data records. By way of example, the memory element 113 also stores additional information about traffic restrictions and the like in association with the data records.

In addition, a driver assistance system 117 may be provided which is supplied with the digital map data.

For the purpose of determining the current vehicle position, the information device 100 has a navigation unit 120 with a satellite navigation receiver 106 which is designed to receive navigation signals from Galileo satellites or GPS satellites, for example. Naturally, the navigation unit with the satellite navigation receiver 106 may also be designed for other satellite navigation systems.

Since the navigation signals cannot always be received in city centers, for example, the information device also has a direction sensor 107, a distance sensor 108, a steering wheel angle sensor 109, possibly a spring excursion sensor 118, an ESP sensor system 104 and/or a visual detector 105 for the purpose of performing compound navigation. The visual detector 105 may be a camera or a beam sensor. A radar may also be provided.

The signals from the GPS receiver and from the other sensors are handled in the control unit 102. The vehicle position ascertained from said signals is aligned with the roadmaps using map matching. The routing information obtained in this manner is finally output via the monitor 110.

In addition, a projector 121 may be provided in order to project the visual information onto an appropriate projection area.

As for the rest, the control unit 102 in combination with the communication unit 115 may be designed to identify a mobile radio network or mobile radio network operator and to make an appropriate association with a particular country or a particular region.

This allows coarse position finding (country identification) to be performed.

Figure 2:
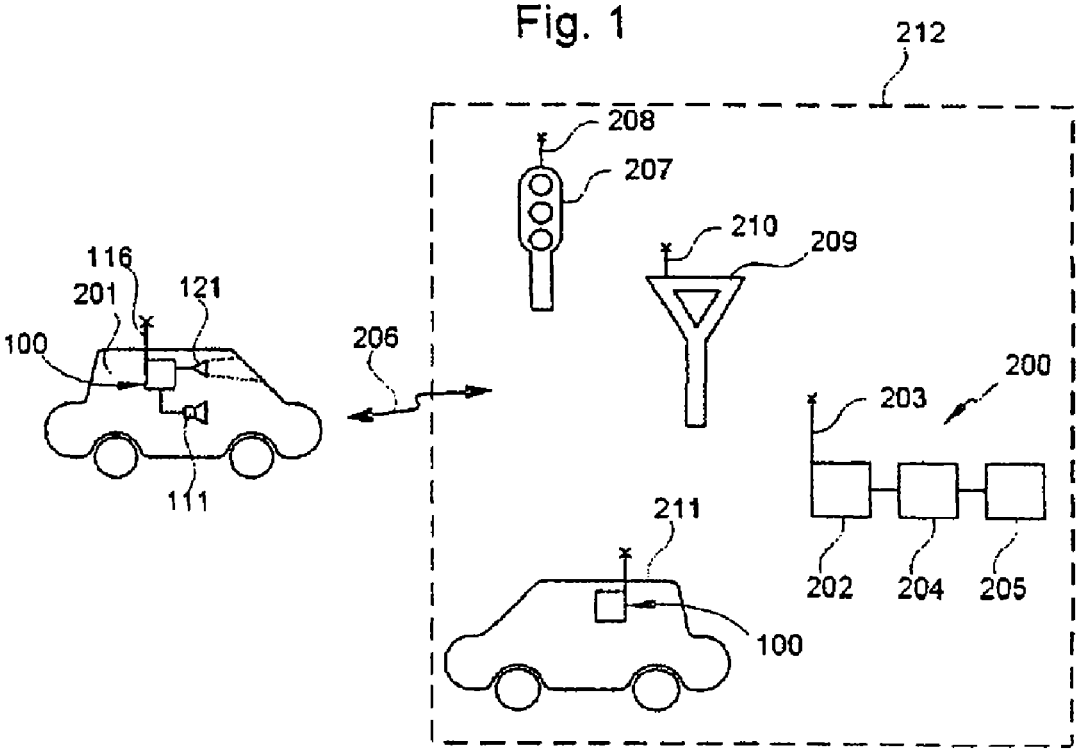
FIG. 2 shows a schematic illustration of an information system based on an exemplary embodiment of the invention.

FIG. 2 shows a schematic illustration of an information system which has a vehicle 201 with an information device 100 and also has a plurality of transmitters.

The transmitters are a transmitter 208 which is installed on or close to traffic lights 207. In addition, a transmitter 210 is provided which is installed on or close to a sign 209. Additionally, a control center 200 is provided which has a communication unit 202 with an antenna 203 and has a central server 204 and also a data store 205.

In addition, a second vehicle 211 with a dedicated information device 100 is provided.

The box 212 combines the transmitters.

All the transmitters can communicate with the information device 100 in the first vehicle 201 and can send information data to said information device 100 via the communication link 206.

Vehicle-to-vehicle or vehicle-to-infrastructure communication is used to signal an approaching emergency vehicle 211 to the vehicle 201. If this information is relevant to the vehicle driver, the sound of a siren is played via the music system 111. In other words, an analysis is also performed in the vehicle 201 to determine whether or not the received information is also of interest to the driver.

While the sound of the siren is being played, an audio source playing beforehand is stopped or attenuated. The sound of the siren can additionally be adapted to suit the local circumstances. It is thus possible for the tone to correspond to that of sirens which are customary in the country or to the tone of the siren from the country in which the driver is most often on the move or the country which the driver has selected. The tone of the siren can also be distorted according to terrain (city, or open country, etc.) and direction of approach of the emergency vehicle (from the front, from the left, etc.) in order to convey a more realistic impression.

Similarly, vehicle-to-vehicle or vehicle-to-infrastructure communication can be used to transmit information about traffic signs or other road signs to the vehicle. These are indicated in the vehicle (visually and, if appropriate, additionally audibly) either exactly in the presentation which has been set up or in another type of presentation which is familiar to the driver. This adaptation of the presentation to suit the driver's habits significantly enhances recognition if the driver is on the move in an environment which is new to him. This allows the reaction time of the driver to be significantly reduced. Hence, road safety is increased.

As one alternative, the country can be identified by means of GPS and digital maps. Somewhat less accurate is identification of the country by means of identification and association of the mobile radio carrier (T-Mobile, Verizon Wireless, etc.), which normally differ from country to country.

Since the information device can identify the country itself, no prior configuration of the device by the user is necessary.

Figure 3:
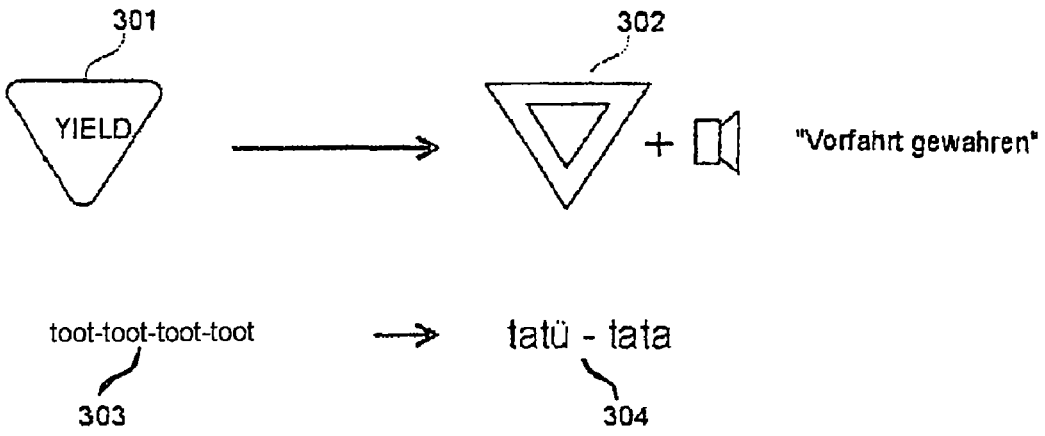
FIG. 3 shows possible transformations of the information data based on an exemplary embodiment of the invention.

FIG. 3 shows a schematic illustration of possible transformations of the information data which are performed within the vehicle. By way of example, the presentations of road signs are made for the driver's native country. If he is on the move in the USA, for example, and his vehicle approaches a "yield" sign 301, the presentation of this sign is transformed to the German standard 302 (the sign has a different appearance and, in addition, the oral information "Vorfahrt gewähren" is played).

When an emergency vehicle approaches, the tone of an appropriate American siren (symbolized by the lettering "toot-toot-toot-toot") 303 is replaced by the tone of a German siren (symbolized by the lettering "tatü-tata") 304.

In other words, the information device simulates an environment with which the driver is familiar by means of an appropriate data transformation which is adapted to suit the individual needs of the driver.

Figure 4:
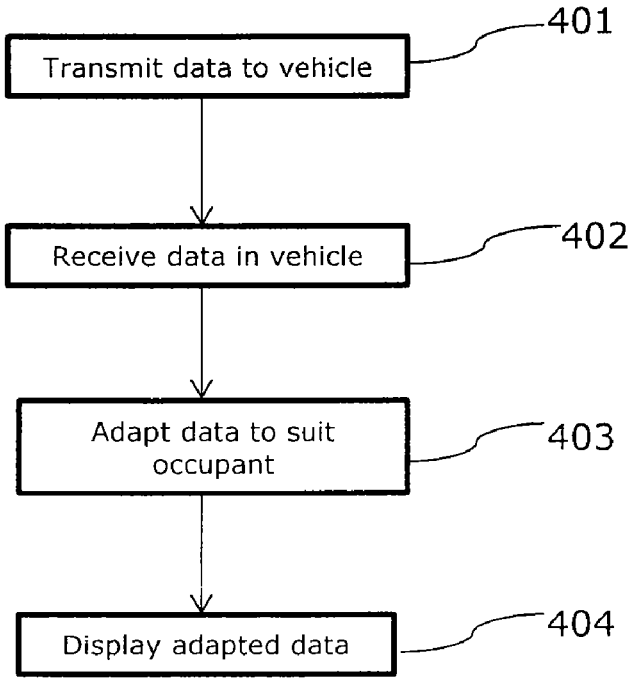
FIG. 4 shows a flowchart for a method based on an exemplary embodiment of the invention.

FIG. 4 shows a flowchart for a method in which, in step 401, information data are transmitted from an external transmitter to the vehicle. In step 402, these data are received in the vehicle, whereupon they are adapted to suit individual needs of the vehicle occupants in step 403. In step 404, the adapted data are then visually displayed and/or audibly presented. In this case, the presented information corresponds to information from road signs along the vehicle route and/or to the movement of an approaching emergency vehicle.

In addition, it should be pointed out that "comprising" and "having" do not exclude other elements or steps, and "a" or "an" does not exclude a large number. Furthermore, it should be pointed out that features or steps which have been described with reference to one of the above exemplary embodiments can also be used in combination with other features or steps from other exemplary embodiments described above.

The invention claimed is:

1. An information device for a vehicle, said information device comprising:

a communication unit in the vehicle for receiving information data in a format of a first country from an external transmitter, the information data including at least one of visual symbols and audio tones corresponding to traveling conditions as the vehicle travels in the first country; and a control unit for individual presentation of the received information, which is adapted to:

convert the at least one of the visual symbols and the audio tones from the format of the first country to a format of a second country determined based on the occupant of the vehicle, and at least one of display the visual symbols and output the audio tones in the format of the second country as the vehicle travels in the first country.

2. The information device as claimed in claim 1, wherein the transmitter is associated with an adjacent vehicle.

3. The information device as claimed in claim 1, wherein the transmitter is a static control center.

4. The information device as claimed in claim 1, wherein the presentation of the received information is adapted to suit a country or an area in which the vehicle is situated.

5. The information device as claimed in claim 1 further comprising:

a position-finding unit for determining the country or the area in which the vehicle is situated;

wherein the country or the area in which the vehicle is situated is determined by a satellite navigation system or an identification and association of a mobile radio network operator.

6. The information device as claimed in claim 1, wherein the presentation of the received information is adapted to suit a country or an area which the driver has selected.

7. The information device as claimed in claim 1, wherein the received information is presented audibly, visually or both audibly and visually.

8. The information device as claimed in claim 1, wherein the received information is presented as a realistic simulation of a sound signal produced by an emergency vehicle.

9. The use of an information device as claimed in claim 1 in a vehicle.

10. An information system for the individual presentation of received information, which is adapted to suit an occupant of a vehicle or a position of the vehicle, said information system comprising:

an information device as claimed in claim 1; and a transmitter for transmitting information data to the communication unit in the vehicle.

11. A method for presenting received information that is adapted to suit an occupant of a vehicle, said method comprising the following steps:

receiving information data in a format of a first country from an external transmitter, the information data including at least one of visual symbols and audio tones corresponding to traveling conditions as the vehicle travels in the first country;

converting the at least one of the visual symbols and the audio tones from the format of the first country to a format of a second country determined based on the occupant of the vehicle; and at least one of displaying the visual symbols and outputting the audio tones by a control unit in the format of the second country as the vehicle travels in the first country.

12. A non-transitory computer-readable medium which stores a computer program product which, when executed on a processor, instructs the processor to perform the following steps:

reception of information data in a format of a first country from an external transmitter, the information data including at least one of visual symbols and audio tones corresponding to traveling conditions as a vehicle with an occupant travels in the first country;

conversion of the at least one of the visual symbols and the audio tones from the format of the first country to a format of a second country determined based on the occupant of the vehicle; and at least one of displaying the visual symbols and outputting the audio tones by a control unit in the format of the second country.

* * * * *